US006209457B1

(12) United States Patent
Kenworthy et al.

(10) Patent No.: US 6,209,457 B1
(45) **Date of Patent: *Apr. 3, 2001**

(54) METHOD AND PREFORMED COMPOSITION FOR CONTROLLED LOCALIZED HEATING OF A BASE MATERIAL USING AN EXOTHERMIC REACTION

(75) Inventors: Michael W. Kenworthy, New York; Sergey A. Sushchenko, Brooklyn, both of NY (US)

(73) Assignee: Technology Commercialization Corp., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/133,621

(22) Filed: Aug. 13, 1998

(51) Int. Cl.[7] ..... B42B 1/02; F42B 3/00; C06C 5/06

(52) U.S. Cl. ..... 102/306; 102/332; 102/275.6; 102/275.11; 149/108.2

(58) Field of Search ..... 102/275.5, 275.6, 102/275.11, 307, 306, 312, 313, 331, 332; 149/22, 108.2

(56) References Cited

U.S. PATENT DOCUMENTS

| | | | | |
|---|---|---|---|---|
| 1,562,123 | * | 11/1925 | Pitts | 102/331 |
| 1,767,182 | * | 6/1930 | Lisse | 102/331 |
| 3,604,354 | * | 9/1971 | Brown et al. | 102/332 |
| 3,942,442 | * | 3/1976 | Advocat | 102/336 |
| 4,024,818 | * | 5/1977 | Scott et al. | 102/331 |
| 4,031,046 | | 6/1977 | Tisza . | |
| 4,363,832 | | 12/1982 | Odawara . | |
| 4,418,622 | * | 12/1983 | Foster et al. | 102/332 X |

(List continued on next page.)

FOREIGN PATENT DOCUMENTS

| | | |
|---|---|---|
| 0108216 | 5/1984 | (EP) . |
| 0409099A3 | 1/1991 | (EP) . |
| 0525808A2 | 2/1993 | (EP) . |
| 0682717 | 11/1995 | (EP) . |
| WO9113296 | 9/1991 | (WO) . |
| WO9416859 | 8/1994 | (WO) . |
| WO9418347 | 8/1994 | (WO) . |

OTHER PUBLICATIONS

Messler RW Jr, Joining Advanced Materials; in:Adv Mater Process Feb. 1995, vol. 147, No. 2, Photomicrographs p.47–49;Abstract.

Sushchenko SA, Properties of Wear–Resistant Coatings Applied by Exothermic Reactions, International Journal of Self–Propagating High–Temperature Synthesis, vol. 2, No. 3, p. 301–305; 1993.

A.G. Merzhanov. Worldwide Evolution and Present Status of SHS as a Branch of Modern R&D (On the 30$^{th}$ Anniversary of SHS). International Journal of Self–Propagation High–Temperature Synthesis, vol. 6, No. 2, 1997, pp. 119–158.

*Primary Examiner*—Peter A. Nelson
(74) *Attorney, Agent, or Firm*—Boris Leschinsky

(57) ABSTRACT

A method and an exothermic composition for controlled localized heating of a base material, said composition comprising an exothermic mixture material, a binder material, and optional filler and starter materials, said exothermic mixture material having a predetermined temperature of burning, said binder material providing said composition in a preformed shape when processed with said exothermic material mixture. Self-propagating high-temperature synthesis (SHS) materials are used as preferred exothermic materials. These compositions can be used for a variety of industrial purposes such as cutting, welding, or coating of various materials.

23 Claims, 2 Drawing Sheets

U.S. PATENT DOCUMENTS

| | | | | |
|---|---|---|---|---|
| 4,428,292 | * | 1/1984 | Riggs | 102/202.7 |
| 4,459,363 | | 7/1984 | Holt . | |
| 4,468,272 | | 8/1984 | Donomoto . | |
| 4,554,031 | | 11/1985 | Kerviel . | |
| 4,718,346 | * | 1/1988 | Schmid et al. | 102/310 |
| 4,763,576 | * | 8/1988 | Kass et al. | 102/331 X |
| 4,942,817 | * | 7/1990 | Ikeda et al. | 102/331 X |
| 5,042,386 | * | 8/1991 | Kruse et al. | 102/364 X |
| 5,064,808 | | 11/1991 | Merzhanov . | |
| 5,145,106 | | 9/1992 | Moore . | |
| 5,149,911 | * | 9/1992 | Ringbloom et al. | 102/302 |
| 5,180,759 | | 1/1993 | Neu . | |
| 5,370,054 | * | 12/1994 | Reams et al. | 102/202.7 X |
| 5,378,533 | | 1/1995 | Ota . | |
| 5,431,104 | * | 7/1995 | Barker | 102/312 |
| 5,468,313 | | 11/1995 | Wallace . | |
| 5,501,154 | * | 3/1996 | Rodney et al. | 102/331 |
| 5,544,585 | | 8/1996 | Duguet . | |
| 5,549,849 | | 8/1996 | Namura . | |
| 5,582,228 | | 12/1996 | Stidham . | |
| 5,619,008 | * | 4/1997 | Chawla et al. | 102/313 X |

* cited by examiner

METHOD AND PREFORMED COMPOSITION FOR CONTROLLED LOCALIZED HEATING OF A BASE MATERIAL USING AN EXOTHERMIC REACTION

BACKGROUND OF THE INVENTION

1. Field of the Invention

The present invention relates generally to a method and a composition for applying controlled amount of heat to a base material. More specifically, controlled heating is applied for the purposes of welding, cutting, second material deposition, or surface coating of the base material. An exothermic reaction is used as a heat source which allows for accurate control of the heating temperature and other parameters of the process. Self-propagating high temperature synthesis (SHS) is used as a preferred type of an exothermic reaction.

2. Description of the prior art

Controlled heating of a base material such as metal, plastic or ceramic plate is utilized widely in various industries. Typically, controlled temperature, location, and duration of heating are needed for welding of two or more base materials where these materials may have different physical properties. Cutting or breaking of a base material is another general application for localized heating wherein controlled heat weakens or partially removes some of the base material whereby creating the line of separation. In addition, various coating applications require melting of a secondary coating material over the base material in order to fuse them together. Here again. specific controlled temperatures and other heating parameters are required for successful outcome of these operations.

Exothermic chemical reactions are known to be used for these purposes. There are several important advantages in using such chemical reactions: being well understood, they provide a convenient means for controlling the amount of heat generated during the reaction process. Also, direct application of the components of such reaction to the base material allows for easy control over the dimensions of the heating area. Another advantage is that these reactions are usually self-sustaining and do not require outside energy supply after ignition which makes them convenient for applications in the field.

Components of a typical exothermic reaction are prepared in advance and mixed together typically in a powder form. Once the powder is distributed over the treatment area, it is ignited and the process of burning provides the source of heat needed to achieve the desired function. These processes are well known and widely used. However, handling of the powdery material is difficult because of several reasons. First of all, accurate dispensing of the powder can not be achieved easily. Secondly, even distribution of the powder is also hard to control. Thirdly, holding the powder in place requires the surface of the base material to be perfectly flat and horizontal and no outside disturbance such as air movements should occur prior to igniting and during the burning process. All these factors have made practical use of the powders somewhat difficult and more importantly may lead to irregularities in heating temperature or duration along the treatment area. The need exists therefore for other forms of delivery of the exothermic materials that are easier to use and allow for accurate metering and application of the exothermic reaction components. Following are some known examples of controlled heating using the principles of exothermic reaction.

A method of manufacturing of a composite material according to the U.S. Pat. No. 4,468,272 by Donomoto describes the way to exothermically reduce the amount of metallic oxides in a binder by adding an oxidizing element into the metal matrix. Given examples of metallic oxides are silica, zirconia, chromium oxides and others. Examples of the oxidizing agent include lithium, calcium, magnesium, aluminum, and others. Importantly, exothermic materials are used in a powder form and compressed together in a cast mold prior to igniting. Without the support of a mold, it would be difficult to use these materials with good repeatability and consistency.

Electrically conductive exothermic fine particle powder is described in U.S. Pat. No. 5,378,533 by Ota and consists of fine spherical particles of non-magnetic material such as glass or resin plated with a metal such as Pt, Au, Ag, or Ni. In addition to using this material as a powder, an exothermic coating or paste is described as containing the above mentioned powder and a synthetic resin binder such as polyimide resin, amide resin, silicone resins and the like. Although the paste may be made with uniform consistency which is advantageous for accurate dispensing, the paste application process introduces irregularities which effect the heating parameters.

U.S. Pat. No. 5,549,849 by Namura describes the use of exothermic materials in the form of a viscous fluid such as a paste, varnish, or glue. The fluid according to the invention consists of exothermic powdery materials such as a mixture of nickel and chromium spherical particles together with scales of graphite and particles of organic carbon. This mixture is then added to the resin varnish such as silicone, alkyd, or epoxy varnish to form a gluey viscous fluid. Although application of this fluid was easier achieved by brushing it onto the base material surface as compared with the typically used powder application, it is still difficult to provide accurate and even distribution of the fluid along the treatment area and therefore heating irregularities would still be present.

The use of preformed exothermic materials in casting of molten metals is described in U.S. Pat. Nos. 4,767,800 and 5,180,759 by Neu. Various exothermic compositions are mentioned such as containing aluminum, magnesium, or another readily oxidizing metal mixed with an oxidizing agent such as iron oxide, sodium nitrate and the like and with an organic fluorine containing such compounds as polyvinyl fluoride or other fluorocarbon polymers. A particulate refractory filler is also usually added to the mixture. These compositions are used in a particulate form such as granules or a powder. Shape preforming is also generally mentioned in this patent particularly describing a cylindrical shape and a flat board. In these cases, a binder is added to the mixture such as a phenol-formaldehyde or urea-formaldehyde resin or alternately a gum such as gum arabic, sulphite lye, or colloidal silica. These shapes repeat the shapes of the corresponding molds and do not allow for easy cutting and dispensing of the exothermic composition in general use. There are also no provisions for attaching of the exothermic materials to the base material. The need exists therefore for a preformed universal shape of the exothermic material which will provide for accurate dispensing and placement of this material for a variety of general applications.

One particularly useful type of exothermic reaction is known as a Self-Propagating High-Temperature Synthesis (SHS). In this smokeless burning chemical reaction, very high temperatures may be generated which are useful for joining and welding purposes as well as for cutting and controlled breaking of hard materials such as certain metals and ceramics. According to Messler (Joining advanced materials, by Messler R W Jr., in: Adv Mater Process, February 1995, 147 (2) Photomicrographs p. 47–49), the SHS process holds particular promise for joining ceramics and intermetallics, in either monoliths or reinforced forms, to themselves, to one another, or to metals. An SHS reaction is initiated between reactants to form a compound that generates a significant heat of formation. An example is given where elemental Nickel and elemental Aluminum powders are reacted while sandwiched between Alloy 600 end elements. The bond interface between the reaction product and substrate has high integrity, and the product filler has high density.

SHS process is used extensively in other applications. Synthesis of refractory materials is described in a U.S. Pat. No. 4,459,363 by Holt: refractory metal nitrites are synthesized during self-propagating combustion process utilizing a solid source of nitrogen. For this purpose, a metal azide is employed, preferably $NaN_3$. The azide is burned with Mg or Ca, and a metal oxide is selected from Groups III-A, IV-A, III-B, IV-B, or a rare earth metal oxide. The mixture of azide, Mg or Ca and metal oxide is heated until ignition temperature at which point an SHS process is initiated which in turn forms the metal nitride while starter materials are depleting in the course of SHS reaction. Similar process is described in U.S. Pat. No. 5,064,808 by Merzhanov to produce oxide superconductors. All these processes use powders as a form of a compound materials. Here again, the use of powders does not offer user friendly handling characteristics and leads to difficulties in accurate dispensing of the reaction components.

Exothermic reactions in general and SHS reactions in particular are used in application of coatings. U.S. Pat. No. 4,363,832 by Odawara describes the use of an aluminum powder mixed with iron oxide pressed against the inside of a pipe due to centrifugal forces originated while the pipe is rotated at high speeds. The powder is then ignited to form a protective ceramic lining inside the pipe. The method of applying the mixture is fairly complex since it calls for high speed uniform rotation of the pipe. A simpler method of mixture application and holding against the surface is needed to provide for easy and uniform deposition of the reaction compounds to the surface of the desired object.

Finally, the use of SHS reaction in applying of wear-resistant coatings is described by one of the inventors of the present invention (Sushchenko SA, Properties of Wear-Resistant Coatings Applied by Exothermic Reactions, International Journal of Self-Propagating High-Temperature Synthesis, Volume 2, Number 3, p. 301–305, 1993). Various SHS reactions are described for application of a protective coating to a substrate by igniting a powdery mixture of SHS reaction components.

Overall, the above mentioned prior art references provide for useful applications of exothermic reactions where a mixture of materials typically in a powder or paste form is applied to the base material and then ignited. Practical difficulties are encountered during the application stage. The need exists therefore for a simple, easy to dispense form of such premixed compounds which will allow for optimal and repeatable heating parameters while reducing the time and efforts needed for such application.

SUMMARY OF THE INVENTION

Accordingly, it is an object of the present invention to overcome the above mentioned drawbacks by providing a novel method and a composition for controlled localized heating of a base material using an exothermic reaction.

More particularly, it is the object of the present invention to provide a method and a composition for controlled localized heating of a base material using an SHS reaction.

According to the method of the present invention, an exothermic reaction components are provided in a preshaped form which is easy to use. Exothermic, and more particularly, SHS compositions comprise the following components:

1. Compounds which can cause a self-propagating high-temperature synthesis reaction;
2. A binder material which provides the above mentioned properties of easy dispensing, separating, cutting, and application of the SHS composition to the base material;
3. An optional filler material; and
4. An optional starter material.

Preferably, the binder material is vaporized by the heat developed during the SHS reaction or, alternately, migrates to the outside of the reaction zone similar to the welding flux so that it does not effect the properties of the materials formed during the reaction process.

The composition according to the present invention can be used for a variety of industrial purposes. Examples of such purposes include: welding of two materials together (such as metals, polymers, ceramics, etc.); deposition of a layer of a secondary material to a base material, such as an abrasive, protective, or wear-resistant coating or a semi- or superconductive layer; cutting of a base material or creating of a weak separating line in a base material.

Providing an exothermic composition materials in a preformed shape has the following advantages:

- Makes these materials easy to use, saves application time and labor;
- Improves control, quality, consistency, uniformity, and repeatability in the use of exothermic materials;
- Allows for accurate positioning of the composition onto the base material;
- Improves control over the shape of the SHS material before and after its reaction;
- Allows for replacement of the traditional welding, deposition, and alloying techniques by improving production efficiencies through the reduction in labor or capital costs, and by improving production quality and safety.

The possible preformed shapes are highly varied. The composition can be made in the form of a thin sheet to, for example, form a coating onto a surface of a base material, or to weld together two materials at their adjoining surface. The sheet can be made such that easy cutting can be used to carve out the desired shape according to the geometry of the base material, for example in a form of a thin narrow strip made from such sheets. In another example, it can be made in rope form, preferably flexible, to seam weld two pipes together at an angle. It can be made in a form of a gasket (flat or with varied thickness) to weld together two materials that have a common interface or a seam. Such gasket can have a round, square or other regular or irregular shape and perimeter, or it can have variously shaped inside cutouts. Line indentations are also possible on the face of the gasket to increase the bonding area and to improve the attachment to a protruding base material such as a pipe by pressing the material onto the gasket. It can be formed in lengths having a V-shape profile to cut through the base material with one or more repeated applications, or to develop a thermally treated weak zone which will define the break line of a brittle material such as glass, cement, or marble when stressed. Various known production techniques can be used to make the composition according to the present invention. Preferred production methods include making the desired form (sheet, strip, rope, or gasket) by extrusion or molding, but other methods such as rolling and pressing are also contemplated.

The binder material providing the above mentioned features of the composition according to the present invention can be chosen from a broad variety of polymers, glues, varnishes, epoxies, drying solvents and the like. Compressing the SHS material with the binder material can sometimes be beneficial as well.

It is another feature of the instant invention to provide a flexible binder material such as polymer to make the formed final exothermic composition. This feature will assist in easy cutting of the material and depositing it on curved surfaces and along curved lines of the base material.

It is yet another object of the present invention to provide a binder material which leaves the final composition rigid or semi-rigid. In that case, less binder material is needed to hold the mixture together if the binder were a varnish, glue, epoxy, or solvent.

According to a further object of the present invention, a binder material is chosen in such a way, that it makes the composition sticky to attach to the base material surface should this surface be curved or not horizontal. In that case, easy deployment on the base material is achieved without the risk of dislodging the composition prior to igniting. Alternately, a sticky coating with an optional easy to remove protective layer is applied to the surface of the preformed shape of the composition in order to provide the same advantages but not to incorporate the sticky compound into the composition itself.

It is a further object of the present invention to provide a binder material in a form of a thin casing to hold an exothermic material together. A rope, a sheet, or a gasket can be produced this way wherein a thin casing is used to pack a powdery exothermic material inside it. Polyethylene, paper, thin fabric, and other materials can be used as a binder material in this application. This form of the composition will provide more flexibility in its application and allow for less binder material to be used or to change the covering qualities of the final composition.

It is yet another object of the instant invention to provide optionally a starter exothermic material as a layer, strip, or segment of the preformed composition. This starter material can be ignited at a lower temperature then the main exothermic material and will in turn ignite the main exothermic material itself.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE FIRST, MOST PREFERRED EMBODIMENT OF THE INVENTION

Figure 1:
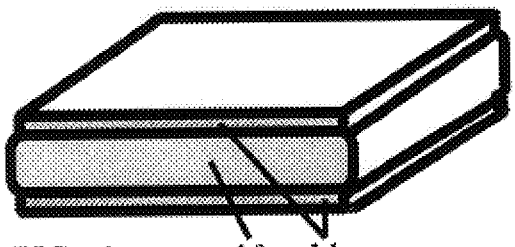
FIGS. 1 and 2 illustrate the cross-sectional structure of the first and most preferred embodiment of the composition according to the present invention consisting of an exothermic material powders mixed with a binder and an optional filler and optionally covered with a protective layer. The preformed shape of a composition is a flat sheet or a V-shaped strip.

A detailed description of the present invention follows with reference to accompanying drawings in which like elements are indicated by like reference numerals.

Figure 2:
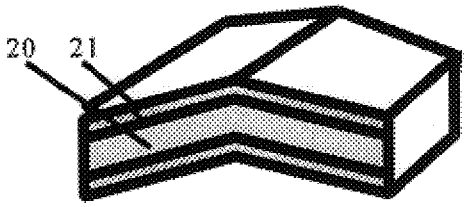

FIGS. 1 and 2 illustrate the first embodiment of the instant invention where in accordance with the method of the invention an exothermic material composition 10 on FIG. 1 is surrounded by an optional protective removable layer 11 which may be made of paper, foil or polymer. FIG. 2 illustrates a similar arrangement having a V-shape where a composition 20 is surrounded by an optional protective coating or layer 21. A separate layer, strip or segment of starter material (not shown) may be incorporated into the shape of the composition to provide the initial heat needed to ignite the exothermic reaction. The composition contains the following compounds:

an exothermic compound itself;

a binder;

an optional filler;

an optional starter material.

EXOTHERMIC MATERIALS

An exothermic material is chosen so that the burning temperature and the burning speed are appropriate for the purposes of the localized heating of a particular base material. The choice is also effected by the chemical and physical properties of both the exothermic materials prior to reaction and the resultant material after the reaction is complete. Additional factor is the strength of the bond between the resultant material and the base material(s). The following table illustrates some examples of exothermic and SHS materials and the burning temperature of their reaction:

TABLE 1

| Components | T, ° C. | Components | T, ° C. | Components | T, ° C. |
|---|---|---|---|---|---|
| Ti + B | 2500 | 5Ti + 3Si | 2350 | Nb + C | 2650 |
| Ti + 2B | 3190 | 2Zr + Si | 1920 | 2Ta + C | 2550 |
| Nb + 2B | 2700 | Zr + Si | 2380 | Ta + C | 2550 |
| Hf + 2B | 3000 | Zr + 2Si | 1950 | Zr + C | 3220 |
| Ta + B | 2700 | Nb + 2Si | 1880 | 2Nb + $N_2$ | 2800 |
| Zr + 2B | 3240 | Mo + 2Si | 1920 | 2Ta + $N_2$ | 2500 |
| Ti + Si | 1850 | Ti + C | 3070 | Ta + 2B | 2300 |
| Ti + 2Si | 1770 | Hf + C | 3000 | | |

For cutting purposes, it is proposed to have the burning temperature of the exothermic material to be 1.2 to 2 times and preferably, 1.5–1.6 times the melting temperature of the base material. For example, for cutting of a material with a melting temperature of 1540° C., the mixture of 5Ti+3Si with the burning temperature of 2350° C. could be preferentially used.

For welding purposes, this ratio should be 1.0–1.5 and preferably 1.0–1.1. Thus, for example the mixture of Ti+Si with the burning temperature of 1850 ° C. may be used to join together parts with the melting temperature in the range of 1680° C. to 1850° C.

Another consideration in choosing the compounds for the exothermic reaction is the amount of heat produced during the burning process. In some applications, this consideration is an important factor in addition to the burning temperature. Exothermic and specifically SHS reactions are well understood. The following are some examples of the amounts of heat generated in the course of such reactions:

$3\ Fe_3O_4+8\ Al \rightarrow 9Fe+4Al_2O_3$: H=3350kJ $3\ FeO+2\ Al \rightarrow 3\ Fe+Al_2O_3$: H=880 kJ $Fe_2O_3+2\ Al \rightarrow 2\ Fe+Al_2O_3$: H=850 kJ $3\ CuO+2\ Al \rightarrow 3\ Cu+Al_2O_3$: H=1250 kJ $3\ Cu_2O+2\ Al \rightarrow 6\ Cu+Al_2O_3$: H=1060 kJ

BINDER MATERIALS

A binder material can be chosen from a wide variety of polymers, glues, varnishes, epoxies, drying solvents and the like. In order to make the final composition flexible, a pliant polyethylene can be used as an example of an appropriate binder material. Specific examples are cyclotrimethylenetrinitramine, or a pliant mixture of 88% by weight of cyclotrimethylenetrinitramine, 8.4% polyisobutilene, 2.4% diethylhexsil, and 1.2% polytetrafluoroethylene.

It is another aspect of the present invention to provide a binder material which is exothermic to some degree by itself. The low burning temperature binder material may be used as a starter to initiate the higher temperature main exothermic reaction. An example of such polyethylene exothermic material is a mixture of triphenylphosphine and chloramine B which has an exothermic reaction temperature of 150° C.

The volume of binder material is preferably in the range of 5% to 20%. The lower number is dictated by the ability of the binder to hold the composition together and the higher number is limited by the objective to provide the higher concentration of the exothermic reaction or filler components.

A combination of several binder materials can also be used depending on a particular application.

FILLER MATERIALS

Various filler materials may be used according to the present invention. They may have several functions. One of the functions is to lower the burning temperature as may be desired for precise temperature control. In another aspect of the invention, the filler material is used to change the physical or chemical characteristics of the final composite material resulting from an exothermic reaction. Yet another function is to provide with the coating materials as may be desired for example for applying a wear-resistant, protective, or abrasive coating on a base material in case these materials are not formed in the process of an exothermic reaction. An example of a filler is an abrasive powder which may be applied to the ceramic substrate to prevent formation of a slippery surface on a construction tile. Another example is deposition of a highly visible and wear-resistant marking material on the surface of the road to mark a pedestrian cross-walk and the like. Yet another useful application of the filler is to add elements and compounds which together with the exothermic reaction materials can produce semi- or superconductive materials.

STARTER MATERIALS

In another aspect of the present invention, a starter material is optionally provided in a form of a layer, line or segment, either inside or on the surface of the preformed composition. This starter material is an exothermic substance, preferably an SHS material, which when ignited, provides sufficient heat to ignite the main exothermic mixture of the preformed composition.

One purpose of this starter material is to lower the ignition temperature required to start the main exothermic reaction. Another purpose of the starter material is to provide a faster reaction speed then the main exothermic reaction of the preformed composition which, when lines or layers of starter material run through or on the preformed composition, will shorten the time required to complete all of the main exothermic reaction of the preformed shape. This fast exothermic reaction time is particularly beneficial for welding applications where non-uniform bonding temperatures can cause warping or deformation of the base materials to be joined together. It can also be beneficial in underwater welding applications where obtaining temperatures required to ignite the main exothermic mixture may be more difficult. Particularly for underwater welding applications, it is beneficial to use an electrical current to ignite the exothermic reaction, such electrical ignition being well understood in the art.

The starter exothermic material may take various forms. It is preferably made from SHS materials in a powder or sheet form, an attached to the surface of the preformed composition with glue or other appropriate means, or can be layered inside the preformed composition. It can alternately be combined with a liquid or paste such as glue, drying solvent or varnish, and then applied to the surface of the preformed composition.

An example of such SHS starter material is a mixture of triphenylphosphine and chloramine B which has a low ignition temperature and an exothermic reaction temperature of 150° C.

DETAILED DESCRIPTION OF THE SECOND EMBODIMENT OF THE INVENTION

Figure 3:
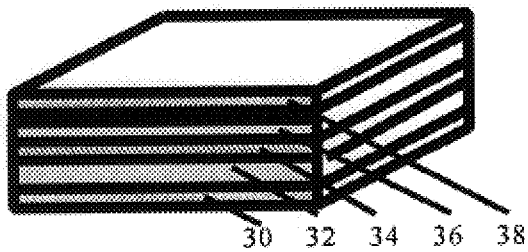
FIGS. 3 and 4 illustrate a cross-section of a second embodiment of the composition in accordance with the present invention wherein a number of strips of materials forming an exothermic reaction are compiled together with optional separation layers and outside protective layers. The preformed shape of a composition is a flat sheet or a V-shaped strip.
Figure 4:
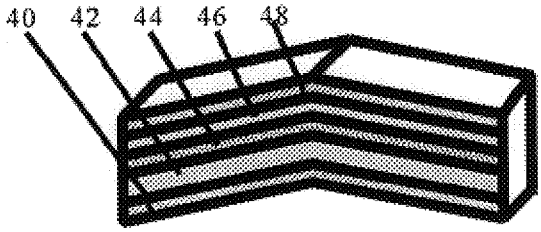

FIGS. 3 and 4 illustrate the second embodiment of the present invention wherein the exothermic materials are used in a form of a foil rather then a powder. In this case, a preformed flat sheet of the final exothermic composition (FIG. 3) can be manufactured by alternating thin layers of exothermic and particularly SHS materials 32 and 36 (these layers constitute two foils, one for each SHS reactant) chosen, for example from Table 1 with the outside binder layers 30 and 38 and an optional separating binder or filler layer 34. These layers can be made of the same or different binder materials depending on the needs of a particular application and based on the principles described for the first embodiment of the present invention. Altemately, the SHS layer may be composed of sandwiched SHS reactants.

Similarly, a V-shaped profile is shown on FIG. 4 having two exothermic layers 42 and 46 and an optional separating layer 44 of a binder or filler material, and optional outside binder or protective layers 40 and 48. A great variety of other profiles can be easily designed by those skilled in the art according to the method of the present invention.

Extrusion, rolling or pressing are suggested to be the best processes to produce the composition according to this embodiment of the invention. However, other techniques can also be considered.

DETAILED DESCRIPTION OF THE THIRD EMBODIMENT OF THE INVENTION.

Figure 5:
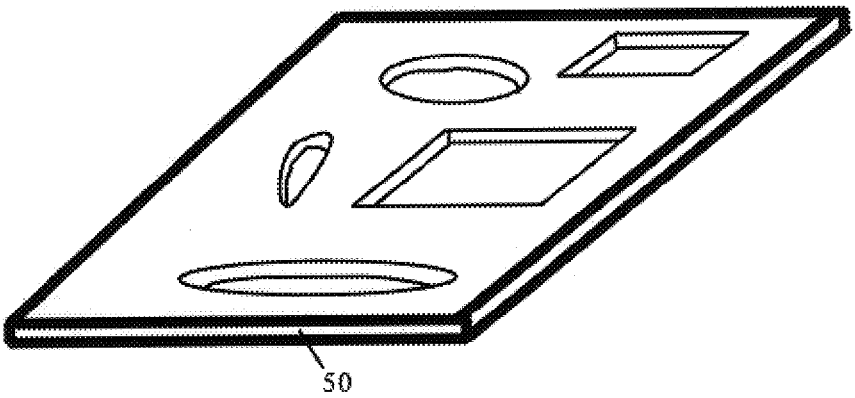
FIG. 5 is an illustration of the third embodiment of the present invention wherein the binder material leaves the final composition ready for easy cutting of the shape needed for a particular application.

FIG. 5 illustrates the third embodiment of the present invention. The exothermic composition designed according to the method of the invention and described in greater detail for the first embodiment of the invention is formed into a flat, possibly pliable sheet 50. The binder material is chosen in such a way that makes it easy to cut the sheet to carve out various shape cutouts and gaskets. This embodiment is quite universal in nature and allows for easy use of the exothermic composition for occasional non-repetitive applications.

DETAILED DESCRIPTION OF THE FOURTH EMBODIMENT OF THE INVENTION.

Figure 6:
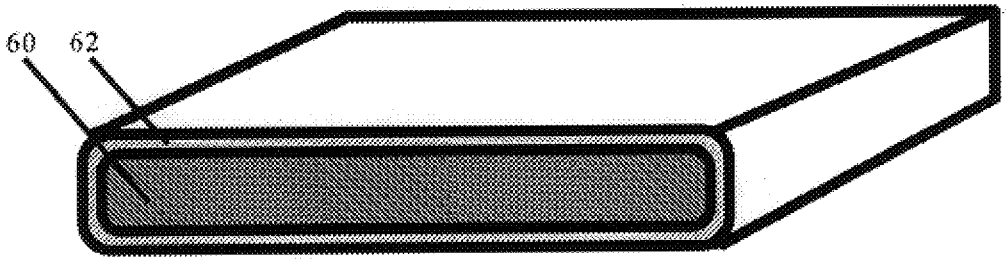
FIG. 6 illustrates the fourth embodiment of the present invention wherein a thin pliable casing which is easy to bend or to cut is used to hold the exothermic material together.

The fourth embodiment of the present invention is illustrated on FIG. 6. According to this embodiment, a thin pliable casing made of a binder material holds the exothermic mixture together. A cross-sectional view on FIG. 6 shows a casing 62 holding an exothermic mixture 60. All materials can be chosen based on detailed descriptions and principles of the first embodiment of the invention. The advantage of the fourth embodiment is the ability to cut the casing to length and form a complicated profile outlining the geometry of the base material. Such casing may be conveniently used as a rope or to form a gasket of an exothermic material. Another advantage is a relatively small volume of a binder in comparison with the exothermic materials since preferably no binder is contained inside the casing.

DETAILED DESCRIPTION OF THE FIFTH EMBODIMENT OF THE INVENTION.

Figure 7:
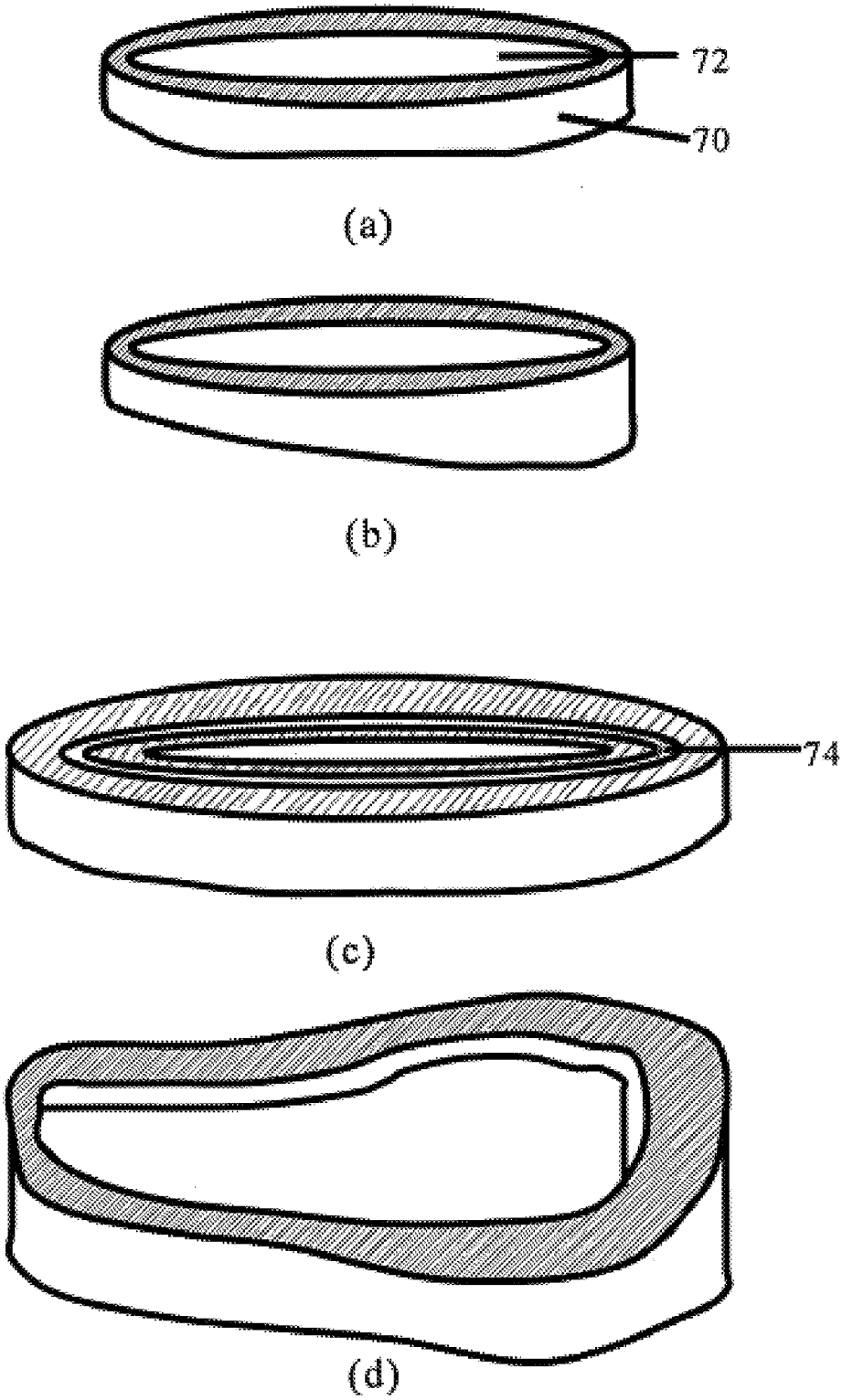
FIGS. 7(*a*) through 7(*d*) illustrate the fifth and final embodiment of the present invention wherein a gasket shape is formed having various shapes, thicknesses, inside and outside perimeters and indentations in any of the surfaces.

The fifth and final embodiment of the present invention is illustrated on FIG. 7. According to this embodiment, the exothermic composition designed based on the invention is formed into a gasket shape. This gasket shape can be in a form of a disk 70 with a center hole cutout 72, similar to a donut shape as shown on FIG. 7(*a*). The thickness of such donut can vary as illustrated on FIG. 7(*b*). A groove or indentation line 74 can be made into any surface of the gasket shape to, for example, insert the end of a pipe to be welded to another object, which will serve to fix the gasket onto the pipe and provide more surface area for bonding between the pipe and the exothermic composition. Such indentations and generally the whole shape of the gasket can be made to accept multiple objects to be welded together. The inside perimeter and surfaces of the gasket shape can be round, square, rectangular or any other appropriate shape as shown on FIG. 7(*d*), and have round edges.

Preferentially in welding applications, starter material will be applied to the perimeter or inside surface of the gasket to have the exothermic reaction proceed more uniformly from the perimeter or inside surface of the gasket radially through the preformed composition.

Although the present invention has been described with respect to several specific embodiments and applications, it is not limited thereto. Numerous variations and modifications readily will be appreciated by those skilled in the art and are intended to be included within the scope of the present invention, which is recited in the following claims.

What we claim is:

1. An exothermic composition material for controlled localized heating of a base material comprising:

an exothermic self-propagating high-temperature synthesis gasless combustion material mixture having a predetermined temperature of burning; and a binder material for providing said composition in a preshaped form when processed with said exothermic self-propagating high-temperature synthesis material mixture, said preshaped form allowing for convenient application and handling of said composition material, whereby upon igniting of said composition material, a self-propagating high-temperature synthesis gasless combustion reaction is initiating, said reaction resulting in formation of a solid material and releasing of a predetermined amount of heat on said base material.

2. The exothermic composition material as in claim 1, wherein said composition material further containing a filler material.

3. The exothermic composition material as in claim 1, wherein said filler material having a wear-resistant property.

4. The exothermic composition material as in claim 1, wherein said filler material having an abrasive property.

5. The exothermic composition material as claimed in claim 1, wherein said composition material containing a starter exothermic material, said starter material when ignited providing sufficient heat to ignite said exothermic self-propagating high-temperature synthesis material mixture, said starter material having a lower ignition temperature than that of said exothermic self-propagating high-temperature synthesis material mixture.

6. The exothermic composition material as claimed in claim 1, wherein said composition material containing a starter exothermic material, said starter exothermic material having a speed of burning higher then that of said exothermic self-propagating high-temperature synthesis material mixture, said starter material being positioned throughout said exothermic composition material, wherein upon igniting of the starter material the exothermic self-propagating high-temperature synthesis reaction is initiated throughout said preformed exothermic composition material at about the same time.

7. The exothermic composition material as in claim 1, wherein said exothermic self-propagating high-temperature synthesis material mixture being a powder prior to said processing with said binder material, said composition material being a flat sheet.

8. The exothermic composition material as in claim 1, wherein said exothermic self-propagating high-temperature synthesis material mixture being a powder prior to said processing with said binder material, said composition material being a flat strip.

9. The exothermic composition material as in claim 1, wherein said exothermic self-propagating high-temperature synthesis material mixture being a powder prior to said processing with said binder material, said composition material being an elongated V-shaped strip.

10. The exothermic composition material as in claim 1, wherein for cutting use purposes said predetermined temperature of burning of said exothermic self-propagating high-temperature synthesis material mixture being about 1.5 to 1.6 times higher then a melting temperature of said base material.

11. The exothermic composition material as in claim 1, wherein for welding use purposes said predetermined temperature of burning of said exothermic self-propagating high-temperature synthesis material mixture being about 1.0 to 1.1 times higher then a melting temperature of said base material.

12. The exothermic composition material as claimed in claim 1, wherein said binder material being itself exothermic and as such being used as a starter material, said binder material when ignited providing enough heat to initiate the burning of said exothermic self-propagating high-temperature synthesis material mixture.

13. The exothermic composition material as claimed in claim 1, wherein said binder material having a volume between about 5 and 20 per cent of said composition total volume.

14. The exothermic composition material as in claim 1, wherein the components of said exothermic self-propagating high-temperature synthesis material mixture having a shape of a foil prior to said processing with said binder material, said composition being a flat sheet.

15. The exothermic composition material as in claim 1, wherein the components of said exothermic self-propagating high-temperature synthesis material mixture having a shape of a foil prior to said processing with said binder material, said composition being a flat strip.

16. The exothermic composition material as in claim 1, wherein the components of said exothermic self-propagating high-temperature synthesis material mixture having a shape of a foil prior to said processing with said binder material, said composition being an elongated V-shaped strip.

17. The exothermic composition material according to claim 1, wherein said binder material having adhesive properties for easy attachment to said base material.

18. The exothermic composition material as in claim 1, wherein said binder material having a form of a casing, said casing containing said exothermic self-propagating high-temperature synthesis material mixture after said processing.

19. The exothermic composition as claimed in claim 1, wherein said composition material having a form of a gasket.

20. The exothermic composition material as claimed in claim 19, wherein said gasket having an uneven thickness.

21. The exothermic composition material as claimed in claim 19, wherein said gasket having indentations along its surface for easy mounting onto said base material.

22. The exothermic composition material as in claim 1, said material containing an adhesive coating for attachment to said base material.

23. A method for controlled localized heating of a base material, said method comprising the steps of:

applying an exothermic composition material to said base material, said composition material comprising an exothermic self-propagating high-temperature synthesis gasless combustion mixture material and a binder material, said exothermic mixture material having a predetermined temperature of burning, said binder material for providing said composition in a preshaped form when processed with said exothermic material mixture, said preshaped form allowing for convenient application and handling of said composition material; and igniting said composition material, whereby initiating a self-propagating high-temperature synthesis gasless combustion reaction resulting in formation of a solid material and releasing of a predetermined amount of heat on said base material.

* * * * *